US009689326B2

(12) United States Patent
Engineer

(10) Patent No.: US 9,689,326 B2
(45) Date of Patent: Jun. 27, 2017

(54) EXHAUST GAS RECIRCULATION SYSTEM WITH PAIRED CYLINDERS

(71) Applicants: Hyundai America Technical Center, Inc., Superior Township, MI (US); Hyundai Motor Company, Seoul (KR); Kia Motors Corporation, Seoul (KR)

(72) Inventor: Nayan Engineer, Canton, MI (US)

(73) Assignees: Hyundai America Technical Center, Inc., Superior Township, MI (US); Hyundai Motor Company, Seoul (KR); Kia Motor Corporation, Seoul (KR)

( * ) Notice: Subject to any disclaimer, the term of this patent is extended or adjusted under 35 U.S.C. 154(b) by 110 days.

(21) Appl. No.: 14/730,881

(22) Filed: Jun. 4, 2015

(65) Prior Publication Data

US 2016/0369752 A1 Dec. 22, 2016

(51) Int. Cl.

| | |
|---|---|
| ***F02D 41/00*** | (2006.01) |
| ***F02M 26/20*** | (2016.01) |
| ***F02M 26/28*** | (2016.01) |
| ***F02M 26/41*** | (2016.01) |
| ***F02M 26/42*** | (2016.01) |

(Continued)

(52) U.S. Cl.

CPC ..... *F02D 41/006* (2013.01); *F02M 26/20* (2016.02); *F02M 26/28* (2016.02); *F02M 26/41* (2016.02); *F02M 26/42* (2016.02); *F02M 26/05* (2016.02)

(58) Field of Classification Search

CPC ..... F02D 41/006; F02B 27/04; F02B 29/06

USPC ..... 123/568, 14, 58.8, 70 R; 701/108

See application file for complete search history.

(56) References Cited

U.S. PATENT DOCUMENTS 3,623,463 A * 11/1971 De Vries ..... F02B 1/00 123/193.6
3,958,540 A * 5/1976 Siewert ..... F02B 1/06 123/25 A (Continued)

FOREIGN PATENT DOCUMENTS

DE 102007029036 A1 12/2008
DE 102007030464 A1 1/2009

(Continued)

OTHER PUBLICATIONS

David Roth, et al., "Valve-Event Modulated Boost System", SAE International, Published Apr. 12, 2010, Downloaded Jul. 9, 2012.

(Continued)

*Primary Examiner* — Mahmoud Gimie
(74) *Attorney, Agent, or Firm* — Brinks Gilson & Lione

(57) ABSTRACT

The present disclosure provides for a vehicle engine having an EGR system where pairs of cylinders are directly connected to each other. For example, a first and second cylinder may be operably connected by a valve actuator where a high energy, blowdown exhaust gas from the first cylinder may flow through a first flow path directly from the first cylinder to the second cylinder. Likewise, during the firing stroke of the second cylinder, a high-energy, blowdown exhaust gas may flow from the second cylinder through a second flow path directly into the first cylinder. This arrangement may pair cylinders to take advantage of high-energy exhaust gas.

20 Claims, 9 Drawing Sheets

(51) Int. Cl.
*F02B 27/04* (2006.01)
*F02M 26/05* (2016.01)

(56) References Cited

U.S. PATENT DOCUMENTS

| | | | | |
|---|---|---|---|---|
| 6,880,501 | B2 * | 4/2005 | Suh | F02B 11/00 123/58.8 |
| 8,495,992 | B2 | 7/2013 | Roth | |
| 8,671,919 | B2 | 3/2014 | Nakasugi et al. | |
| 9,038,582 | B2 * | 5/2015 | Gehrke | F02B 1/12 123/299 |
| 2001/0050070 | A1 | 12/2001 | Xu et al. | |
| 2004/0168655 | A1 * | 9/2004 | Hitomi | F01L 1/185 123/58.8 |
| 2009/0044771 | A1 | 2/2009 | Ezaki | |
| 2009/0283061 | A1 * | 11/2009 | Branyon | F02B 33/22 123/58.8 |
| 2014/0158067 | A1 | 6/2014 | Woo et al. | |

FOREIGN PATENT DOCUMENTS

| | | | |
|---|---|---|---|
| JP | 2007-027022 | A | 1/1995 |
| JP | 2007-023814 | A | 2/2007 |
| KR | 10-2004-0025212 | A | 3/2004 |
| KR | 10-1394047 | B | 5/2014 |

OTHER PUBLICATIONS

David B. Roth, et al., "Valve-Event Modulated Boost System: Fuel Consumption and Performance with Scavenge-Sourced EGR", SAE International, Published Apr. 16, 2012, Downloaded Jul. 9, 2012, pp. 538-546.

* cited by examiner

EXHAUST GAS RECIRCULATION SYSTEM WITH PAIRED CYLINDERS

BACKGROUND

1. Field of the Invention

The present invention relates to an internal combustion engine. In particular, the present invention relates to an exhaust gas recirculation ("EGR") system and method to operate the system using paired cylinders.

2. Background

In various engines, exhaust gases may be generated as combustion chambers or cylinders perform their firing strokes. Exhaust gas recirculation ("EGR") is a widely used method to utilize these exhaust gases to improve combustion efficiency. In general, EGR improves fuel consumption and reduces emission of nitrogen oxides ("NOx") by recirculating exhaust gases through engine cylinders as they intake fuel and air.

Modern EGR systems may utilize high pressure routing, in which exhaust gas is redirected into a combustion chamber or cylinder from other cylinders, or low pressure routing, in which exhaust gas is redirected into cylinders after going through a catalytic converter. In both of these systems, exhaust gases are ultimately exhausted from the engine through an exhaust pathway. These gases may be redirected along many points in their exhaust pathways back to the cylinders to perform EGR. There still exists a need for improved EGR systems and methods to operate these systems.

BRIEF SUMMARY OF THE INVENTION

The invention may include any of the following embodiments in various combinations and may also include any other aspect described below in the written description or in the attached drawings. In a first embodiment, this disclosure provides an internal combustion engine having a first, second, third, and fourth cylinder. Each cylinder may have four ports: a primary intake port, a primary exhaust port, an auxiliary intake port, and an auxiliary exhaust port.

For example, the first cylinder may have a first auxiliary exhaust port operably connected to a first auxiliary exhaust valve. The first cylinder may also have a first auxiliary intake port operably connected to a first auxiliary intake valve. Likewise, the second cylinder may have a second auxiliary exhaust port operably connected to a second auxiliary exhaust valve, and a second auxiliary intake port operably connected to a second auxiliary intake valve. A flow path may directly connect the first and second cylinders.

The engine may further have a valve actuator operably connected to the first auxiliary exhaust and intake valves and the second auxiliary exhaust and intake valves to open and close the first auxiliary exhaust and intake ports and the second auxiliary exhaust and intake ports, respectively. The valve actuator may operate the valves to directly connect the first auxiliary exhaust port to only the second auxiliary intake port (by way of the flow path), and directly connect the second auxiliary exhaust port to only the first auxiliary intake port (by way of the flow path). This may provide direct exchange of exhaust gases between the first and second cylinders.

In a further embodiment, the engine may include the third cylinder having a third auxiliary exhaust port operably connected to a third auxiliary exhaust valve, and a third auxiliary intake port operably connected to a third auxiliary intake valve. Likewise, the fourth cylinder may have a fourth auxiliary exhaust port operably connected to a fourth auxiliary exhaust valve, and a fourth auxiliary intake port operably connected to a fourth auxiliary intake valve.

The valve actuator may operably connected to the third auxiliary exhaust and intake valves and the fourth auxiliary exhaust and intake valves to open and close the third auxiliary exhaust and intake ports and the fourth auxiliary exhaust and intake ports, respectively. The valve actuator may operate the valves to directly connect the third auxiliary exhaust port to only the fourth auxiliary intake port, and directly connect the fourth auxiliary exhaust port to only the third auxiliary intake port.

This arrangement may provide direct exchange of exhaust gases between the third and fourth cylinders. Further, this embodiment may be arranged such that neither the first cylinder nor the second cylinder is fluidically connected to either of the third cylinder or the fourth cylinder via their respective auxiliary exhaust and intake ports.

The engine may have an exhaust gas exchange manifold having a first chamber and a second chamber. The first chamber may directly connect the first cylinder to only the second cylinder, and the second chamber may directly connect the third cylinder to only the fourth cylinder. Each chamber may have a length and a volume. For example, the first chamber has a first length and a first volume, and the second chamber has a second length and a second volume. The first length may be about the same as the second length; the first volume may be about the same as the second volume. "About" or "substantially" mean that two given quantities (e.g. lengths or volumes) are within 10% of each other, preferably within 5% of each other, more preferably within 1% of each other. For example, the quantity of the first length is within 10% of the quantity of the second length. This allows accounting for manufacturing tolerances to provide substantially equal chambers. In some embodiments, the first chamber is not in fluid communication or out of fluid communication with the second chamber.

The engine also may have rocker arms to control the auxiliary valves. For example, a first rocker arm may be operably connected to the first auxiliary intake valve, in a first intake position, the first rocker arm being operably connected to the first auxiliary exhaust valve, in a first exhaust position. The engine may have a second rocker arm being operably connected to the second auxiliary intake valve, in a second intake position, the second rocker arm being operably connected to the second auxiliary exhaust valve, in a second exhaust position.

The first rocker may be moveable between the first auxiliary exhaust and intake positions by the valve actuator having a first rocker arm lobe, the first rocker arm lobe having 360° rotation about the valve actuator. The first rocker arm may be in the first exhaust position when the first rocker arm lobe is positioned at about 50° rotation about the valve actuator. In addition, the first rocker arm may be in the first exhaust position when the second rocker arm is in the second intake position, and the first rocker arm may be in the first intake position when the second rocker arm is in the second exhaust position. This may provide exchange of exhaust gases between the first and second cylinders.

The engine may have a third rocker arm being operably connected to the third auxiliary intake valve, in a third intake position, the third rocker arm being operably connected to the third auxiliary exhaust valve, in a third exhaust position. The engine may have a fourth rocker arm being operably connected to the fourth auxiliary intake valve, in a fourth intake position, the fourth rocker arm being operably connected to the fourth auxiliary exhaust valve, in a fourth exhaust position.

Because of the arrangements discussed herein, the engine may generate a first exhaust gas that flows from the first auxiliary exhaust port only to the second auxiliary intake port. The engine may generate a second exhaust gas that flows from the second auxiliary exhaust port only to the first auxiliary intake port. Further, the exhaust gas exchange manifold includes a cooling element disposed about the first and second chambers to cool the exhaust gases.

In a second embodiment, the engine may define a longitudinal axis and have a primary exhaust manifold, an exhaust gas recirculation manifold, a first cylinder, and a second cylinder. In this embodiment, the first cylinder may be positioned between a first side and a second side of the engine. The first side may be opposite the second side about the longitudinal axis. The first cylinder may have a first primary exhaust port operably connected to a first primary exhaust valve, a first primary intake port operably connected to a first primary intake valve, a first auxiliary exhaust port operably connected to a first auxiliary exhaust valve, and a first auxiliary intake port operably connected to a first auxiliary intake valve.

The second cylinder may be positioned in-line with the first cylinder, the second cylinder also being between the first side and the second side. The second cylinder may have a second primary exhaust port operably connected to a second primary exhaust valve, a second primary intake port operably connected to a second primary intake valve, a second auxiliary exhaust port operably connected to a second auxiliary exhaust valve, and a second auxiliary intake port operably connected to a second auxiliary intake valve. The primary exhaust manifold may be positioned on the first side of the engine, and the exhaust recirculation manifold may be positioned on the second side of the engine.

The first primary exhaust and intake ports and the second primary exhaust and intake ports may be positioned on the first side. The first auxiliary exhaust and intake ports and the second auxiliary exhaust and intake ports may be positioned on the second side. The first and second primary exhaust port may be in selective fluid communication with the primary exhaust manifold, and the first and second auxiliary exhaust and intake ports may be in selective fluid communication with the exhaust gas recirculation manifold.

In this embodiment, the gas recirculation manifold may have a first flow path connected to the first auxiliary exhaust port and extending only from the first auxiliary exhaust port to the second auxiliary intake port. The first flow path may be in selective fluid communication with the first cylinder and the second cylinder by way of the first auxiliary exhaust port and the second auxiliary intake port. The exhaust gas recirculation manifold may also have a second flow path connected to the second auxiliary exhaust port and extending only from the second auxiliary exhaust port to the first auxiliary intake port. The second flow path may be in selective fluid communication with the first cylinder and the second cylinder by way of the second auxiliary exhaust port and the first auxiliary intake port.

In yet another embodiment, this disclosure provides a method of operating exhaust gas recirculation in an internal combustion engine. The method comprises providing an engine having a first cylinder and a second cylinder. The first cylinder may have a first primary exhaust port, a first primary intake port, a first auxiliary exhaust port, and a first auxiliary intake port. Likewise, the second cylinder may have a second primary exhaust port, a second primary intake port, a second auxiliary exhaust port, and a second auxiliary intake port.

The method may include (1) intaking air into the second cylinder via the second primary intake port; (2) firing the first cylinder, wherein firing the first cylinder generates a first exhaust gas; (3) exhausting a portion of the first exhaust gas through only the first auxiliary exhaust port; (4) intaking the portion of the first exhaust gas from the first auxiliary exhaust port into only the second auxiliary intake port; and (5) exhausting a remainder of the first exhaust gas through the first primary exhaust port.

The method may also include (1) intaking air into the first cylinder via the first primary intake port; (2) firing the second cylinder, wherein firing the second cylinder generates a second exhaust gas; (3) exhausting a portion of the second exhaust gas through only the second auxiliary exhaust port; (4) intaking the portion of the second exhaust gas from the second auxiliary exhaust port into only the first auxiliary intake port; and (5) exhausting a remainder of the second exhaust gas through the second primary exhaust port.

If the engine has a third cylinder and a fourth cylinder, the method may include providing the third cylinder having a third primary exhaust port, a third primary intake port, a third auxiliary exhaust port, and a third auxiliary intake port. In this embodiment, the fourth cylinder may have a fourth primary exhaust port, a fourth primary intake port, a fourth auxiliary exhaust port, and a fourth auxiliary intake port.

The method may further include (1) intaking air into the fourth cylinder via the fourth primary intake port; (2) firing the third cylinder, wherein firing the third cylinder generates a third exhaust gas; (3) exhausting a portion of the third exhaust gas through only the third auxiliary exhaust port; (4) intaking the portion of the third exhaust gas from the third auxiliary exhaust port into only the fourth auxiliary intake port; and (5) exhausting a remainder of the third exhaust gas through the third primary exhaust port.

The method may further include (1) intaking air into the third cylinder via the third primary intake port; (2) firing the fourth cylinder, wherein firing the fourth cylinder generates a fourth exhaust gas; (3) exhausting a portion of the fourth exhaust gas through only the fourth auxiliary exhaust port; (4) intaking the portion of the fourth exhaust gas from the fourth auxiliary exhaust port into only the third auxiliary intake port; and (5) exhausting a remainder of the fourth exhaust gas through the fourth primary exhaust port.

As one possible advantage of the above described embodiments and arrangements, the EGR system described herein may provide a direct pairing between cylinders and direct routing of exhaust gases from one cylinder to another. This direct routing may allow the intaking cylinder receiving the blowdown exhaust gas during its intaking stroke to take advantage of the initial high pressure, high energy exhaust gas. As will be apparent to one skilled in the art, if such high energy gas had to be routed through various pathways, possibly being longer in length, this gas would not retain as much high energy upon entering the intaking cylinder.

The present disclosure may be better understood by referencing the accompanying figures.

DETAILED DESCRIPTION

The present disclosure will now be described more fully with reference to the accompanying figures, which show preferred embodiments. The accompanying figures are provided for general understanding of the structure of various embodiments. However, this disclosure may be embodied in many different forms. These figures should not be construed as limiting and they are not necessarily to scale.

The following definitions will be used in this application.

"BDC" refers to bottom dead center.

"EG" refers to exhaust gas.

"SOHO" refers to single overhead cam.

"TDC" refers to top dead center.

"TWC" refers to a three way catalyst or three-way catalytic converter.

Figure 1:
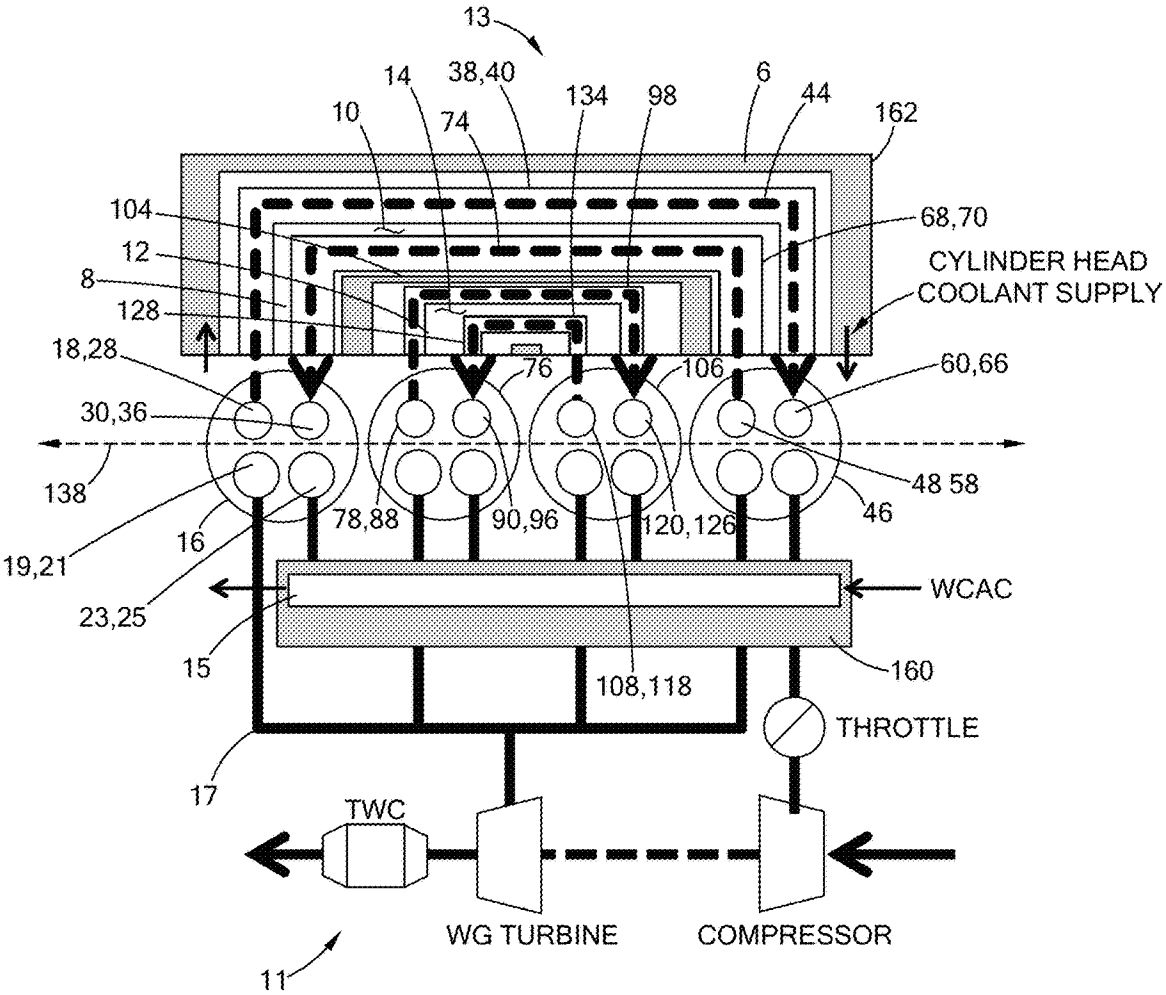
FIG. 1 depicts a partial, schematic top view of an internal combustion engine in accordance with embodiments of the present invention.

FIG. 1 depicts a schematic top view of an internal combustion engine in accordance with embodiments of the present invention. FIG. 1 depicts four cylinders (16, 76, 106, 46) in-line with each other. As will become apparent, one skilled in the art will understand that any number of even cylinders may be used in this engine, and the cylinders may be in-line or rotated (e.g. in V-shape or the like). The four cylinders of the engine, being in-line, define a longitudinal axis 138. The longitudinal axis 138 generally splits the engine shown into two opposing sides of the engine (1, 2).

The first side 11 contains the primary intake manifold 15 and the primary exhaust manifold 17. The second side 13 contains the EGR manifold 6, constructed in accordance with the teachings of the present disclosure. As depicted in FIG. 1, intake air may come into the engine via the primary intake manifold 15, coupled to a throttle and cooled by a water cooled air cooler ("WCAC"). Similarly, EG may leave through the primary exhaust manifold 17, a turbine, and TWC.

Each of the four cylinders depicted preferably have four ports operably connected to four valves. For example, the first cylinder 16 has a first primary exhaust port 21 operably connected to a first primary exhaust valve 19, and a first primary intake port 25 connected to a first primary intake valve 23. The first cylinder 16 also has a first auxiliary exhaust port 28 operably connected to a first auxiliary exhaust valve 18, and a first in auxiliary intake port 36 connected to a first auxiliary intake valve 30. In further example, the second cylinder 46 may also have a second auxiliary exhaust port 58 operably connected to a second auxiliary exhaust valve 48, and a second auxiliary intake port 66 operably connected to a second auxiliary intake valve 60.

The engine may further have a valve actuator, such as a camshaft, (not shown here) connected to the first auxiliary exhaust and intake valves and the second auxiliary exhaust and intake valves to open and close the first auxiliary exhaust and intake ports and the second auxiliary exhaust and intake ports, respectively. The valve actuator may operate the valves to directly connect the first auxiliary exhaust port 28 to only the second auxiliary intake port 66. Likewise, the valve actuator may also directly connect the second auxiliary exhaust port 58 two only the first auxiliary intake ports 36. This provides direct exchange of EG between only the first and second cylinders (16, 46).

As shown in FIG. 1, the engine may further have a third cylinder 76 and a fourth cylinder 106. Just as with the first and second cylinders, the third cylinder 76 may have a third auxiliary exhaust ports 88 operably connected to a third auxiliary exhaust valve 78, and a third auxiliary intake port 96 operably connected to a third auxiliary intake valve 90. The fourth cylinder 106 may have a fourth auxiliary exhaust port 118 operably connected to the fourth auxiliary exhaust valve 108, and a fourth auxiliary intake port 126 operably connected to a fourth auxiliary intake valve 120.

As described above, the valve actuator may operably connect to the third auxiliary exhaust and intake valves and the fourth auxiliary exhaust and intake valves to open and close the third auxiliary exhaust and intake ports and the fourth auxiliary exhaust and intake ports, respectively. The valve actuator may operate the valves to directly connect the third auxiliary exhaust port 88 to only the fourth auxiliary intake port 126, and directly connecting the fourth auxiliary exhaust ports 118 to only the third auxiliary intake port 96. This provides direct exchange of EG only between the third and fourth cylinders (76, 106).

By directly providing EGR between the first and second cylinders (or third and fourth cylinders) EG phasing is simplified. Likewise, issues with controlled distribution among the cylinders (mal-distribution) are mitigated or eliminated. The structure to preform EGR is also simplified, as a single manifold with limited piping and a single cam shaft can be used in this design.

This direct exchange of EG may be accomplished by the formation of the EGR manifold 6. The EGR manifold 6 may comprise a first flow path 38 connected to the first auxiliary exhaust port 28 and extending only from the first auxiliary exhaust port 28 to the second auxiliary intake port 66. The first flow path 38 may be in selective fluid communication with the first cylinder 16 and the second cylinder 46 by way of the first auxiliary exhaust port 28 and a second auxiliary intake port 66.

Similarly, the EGR manifold 6 may comprise a second flow path 68 connected to the second auxiliary exhaust port 58 and extending only from the second auxiliary exhaust port 58 to the first auxiliary intake port 36. The second flow path 68 may be in selective fluid communication with the first cylinder 16 and a second cylinder 46 by way of the second auxiliary exhaust or 58 and the first auxiliary intake port 36. In this way, a first exhaust gas 44 may flow from the first auxiliary exhaust port 28 only to the second auxiliary intake port 66. A second exhaust gas 74 may flow from the second auxiliary exhaust port 58 only to the first auxiliary intake port 36. The engine may generate a third exhaust gas 104 in a third flow path 98 and a fourth exhaust gas 134 in a fourth flow path 128, each being similar to the first and second EGs (44, 74).

The first flow path 38 and a second flow path 68 may be formed similarly. For example, the first flow path 38 and a second flow path 68 may have the same length and accommodate the same volume. In one example, the first flow path may have a first flow path length 40 and the second flow path may have a second flow path length 70 such that each length is less than or equal to 1 meter (m). This 1 meter or shorter length may provide advantages in the direct flow of blowdown EG.

It will be apparent that neither of the first cylinder 16 nor the second cylinder 46 may be fluidly connected to either of the third cylinder 76 or the fourth cylinder 106 via their respective auxiliary exhaust and intake ports.

FIG. 1 also depicts two chambers within the EGR manifold 6. For example, the EGR manifold 6 may have a first chamber 8 with a first length and a first volume 10, and a second chamber 12 with a second length and a second volume 14. Both chambers (10, 12) may be visible here, but it may be apparent that one chamber may also be obscured by the other (e.g. under the other) in a top view.

The first chamber 8 may directly connect the first cylinder 16 to only the second cylinder 46. The second chamber 12 may directly connect the third cylinder 76 to only the fourth cylinder 106. As with the first and second flow path lengths (40, 70), the first length may be about or substantially the same as the second length. Likewise, the first volume 10 may be about the same or substantially the same as the second volume 14. The first chamber 8 may not be in fluid communication, or out of fluid communication with, the second chamber 12.

In FIG. 1, each manifold depicted may have a cooling element disposed about the manifold. For example, cooling element or unit 160 may be disposed about the primary intake manifold 15, and cooling element 162 may be disposed about the EGR manifold 6. The cooling element may be water cooled, air cooled, and the like, as will be known to a person of ordinary skill in this art.

Each cylinder may have primary ports located on the first side 11 and secondary ports located on the second side 2. For example, the first cylinder 16 is positioned between the first side 11 and a second side 13 of the engine. The first cylinder 16 has a first primary exhaust port 21 and a first primary intake port 25 positioned on the first side 1, and the first auxiliary exhaust port 28 and the second auxiliary exhaust port 36 being positioned on the second side 2.

Likewise, the second cylinder 46 has the second primary exhaust and intake ports being positioned on the first side 1, and the second auxiliary exhaust port 58 and the second auxiliary intake port 66 being positioned on the second engine side 2. In this arrangement, the first and second primary exhaust ports are in selective fluid communication with the primary exhaust manifold 17. Thus, first and second auxiliary exhaust and intake ports are in selective fluid communication with the EGR manifold 6. This arrangement is also seen with the third and fourth cylinders (76, 106).

By providing EGR exhausting and intaking on the same side of the engine, the flow paths can be shortened (e.g. <1 m). In addition, this arrangement may allow for simplified routing (e.g. a single manifold without additional pipes).

FIG. 2 depicts side views of the engine described herein performing EGR. As described above, the engine may have four cylinders with four ports each. In FIG. 2, only two ports are shown per cylinder because the two other ports may be obscured. The first cylinder 16 has a first primary exhaust port 21 and a first primary intake port 25. The first cylinder 16 also has a first auxiliary exhaust port and a first auxiliary intake port (obscured by the primary ports).

The ports may be operably connected to a valve actuator, such as camshaft 136. The auxiliary valves (obscured in this view) may be operated by rocker arms (20, 50, 80, 110), discussed further below. Each rocker arm may be operated by a rocker arm lobe around the camshaft 136 (26, 56, 86, 116). For example, a first rocker arm 20 may be operated to open and close the first auxiliary intake port by a first rocker arm lobe 26. This operation will be discussed in further detail in FIG. 3 below.

Figure 2A:
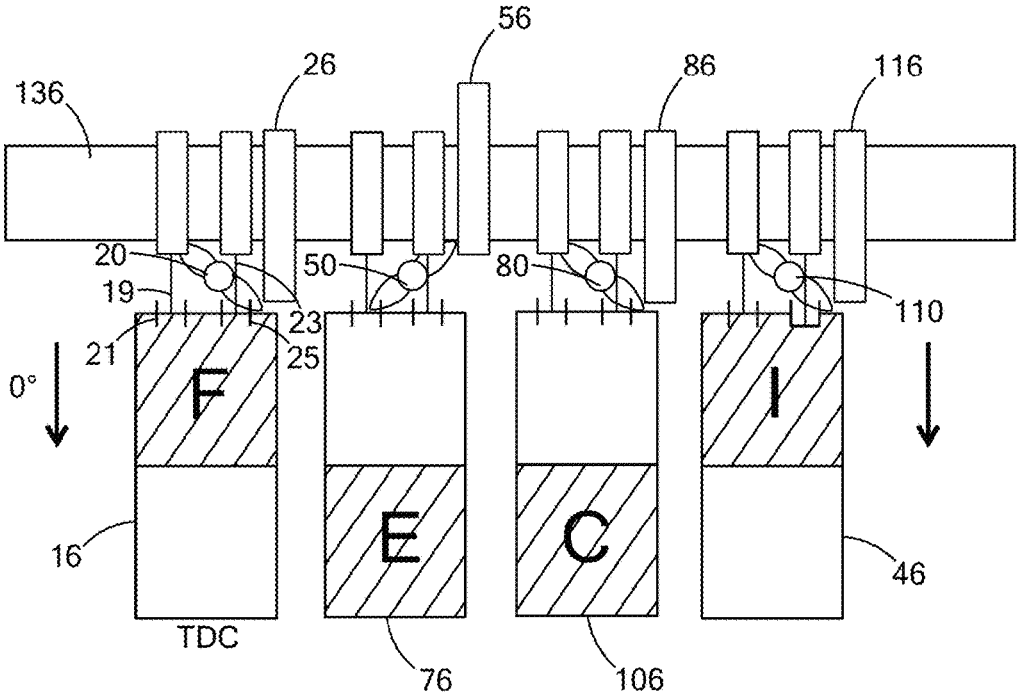
FIGS. 2A-G depict operation steps of the engine of FIG. 1.

It will be understood that the second cylinder 46, the third cylinder 76, and the fourth cylinder 106 each have the same arrangement as the first cylinder 16, with a primary exhaust port, a primary intake port, an auxiliary exhaust port, and an auxiliary intake port. In FIG. 2A, the valve actuator 136 is positioned at 0° crank angle. The first cylinder 16 is at TDC preparing for its firing stroke, and the third cylinder 76 is at BDC after exhausting. In this position, the second cylinder 46 is intaking air via the second primary intake port.

Figure 2B:
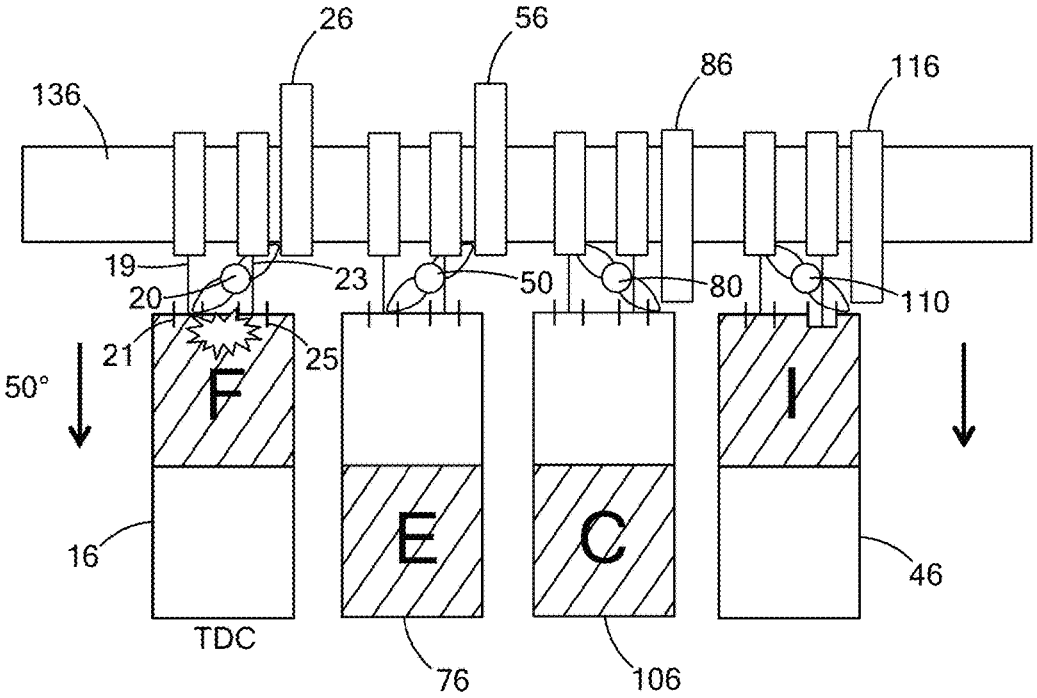

In FIG. 2B, the crank angle has rotated to 50° and the first cylinder 16 is in its firing stroke, generating a first exhaust gas. Firing pushes the first cylinder 16 towards BDC, and exhausts a portion of the first exhaust gas through only the first auxiliary exhaust port. After the first exhaust gas is exhausting through only the first auxiliary exhaust port, the second cylinder 46 is intaking the portion of the first exhaust gas from the first auxiliary exhaust port into only the second auxiliary intake port. After the portion of the first exhaust gas has is intaken into the second cylinder 46, a remainder of the first exhaust gas is exhausted through the first primary exhaust port 21.

Figure 2C:
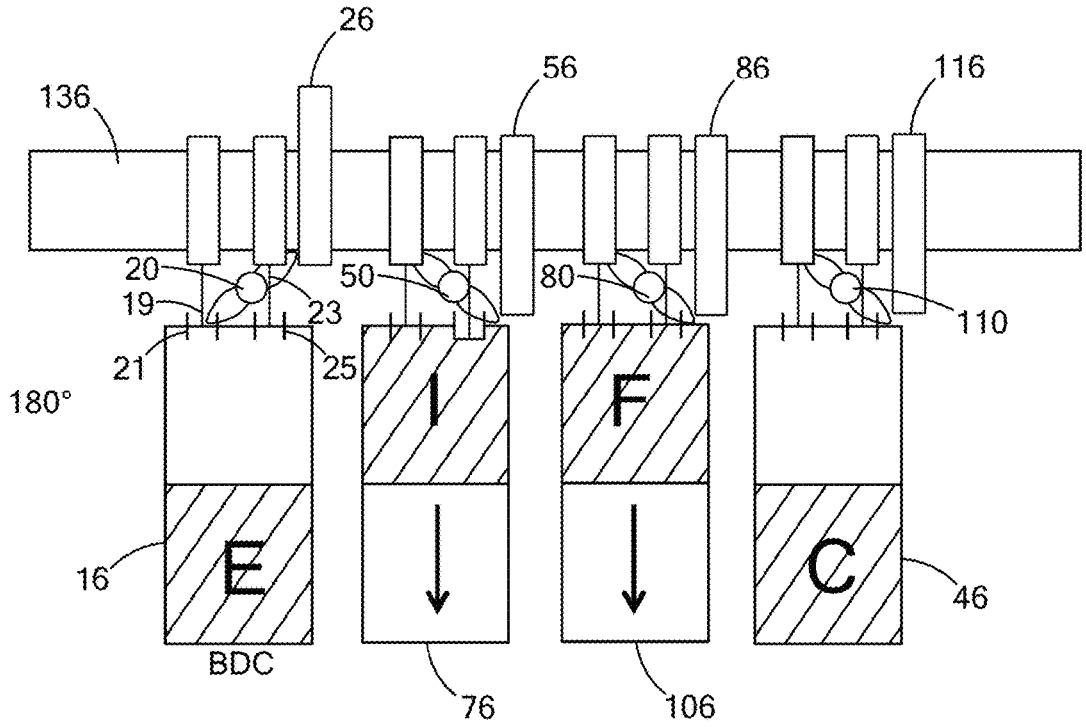
Figure 2D:
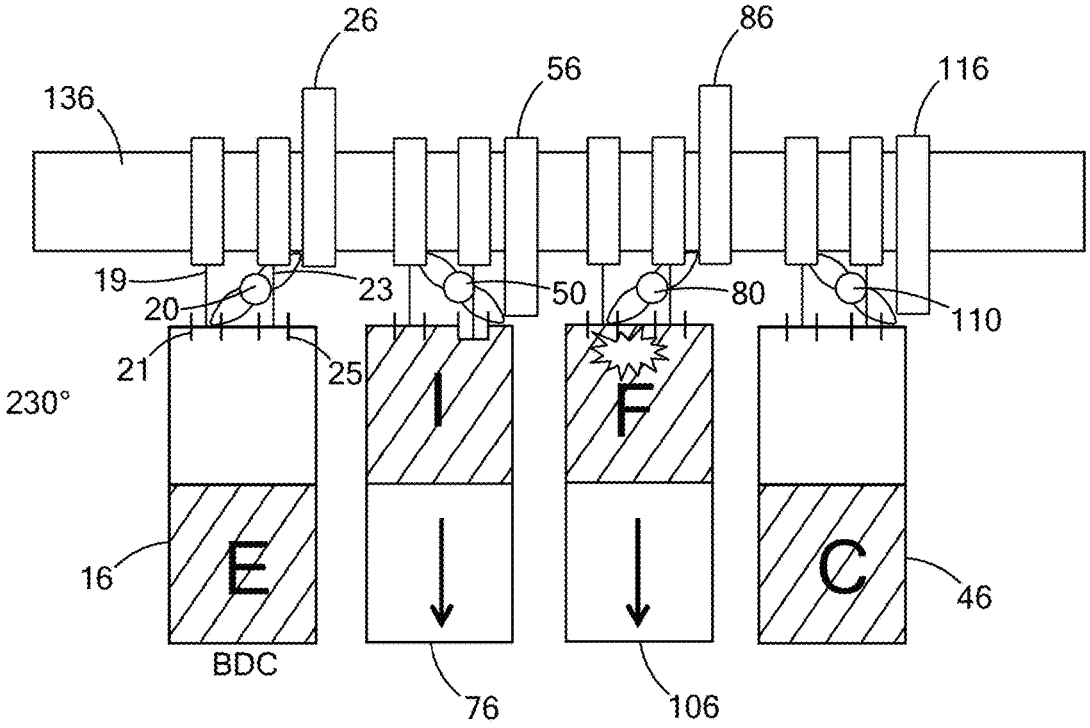

In FIG. 2C, the crank angle has rotated to 180°, and the fourth cylinder 106 is preparing for its firing stroke. At this point, the third cylinder 76 is intaking air via the third primary intake port. In FIG. 2D, the crank angle has rotated to 230°, and the fourth cylinder 106 is in its firing stroke, generating a fourth exhaust gas. A portion of the fourth exhaust gas is exhausted through only the fourth auxiliary exhaust port. The portion of the fourth auxiliary exhaust gas is intaken into only the third auxiliary intake port. Subsequently, a remainder of the fourth exhaust gas is exhausted through the fourth primary exhaust port to empty the cylinder.

Figure 2E:
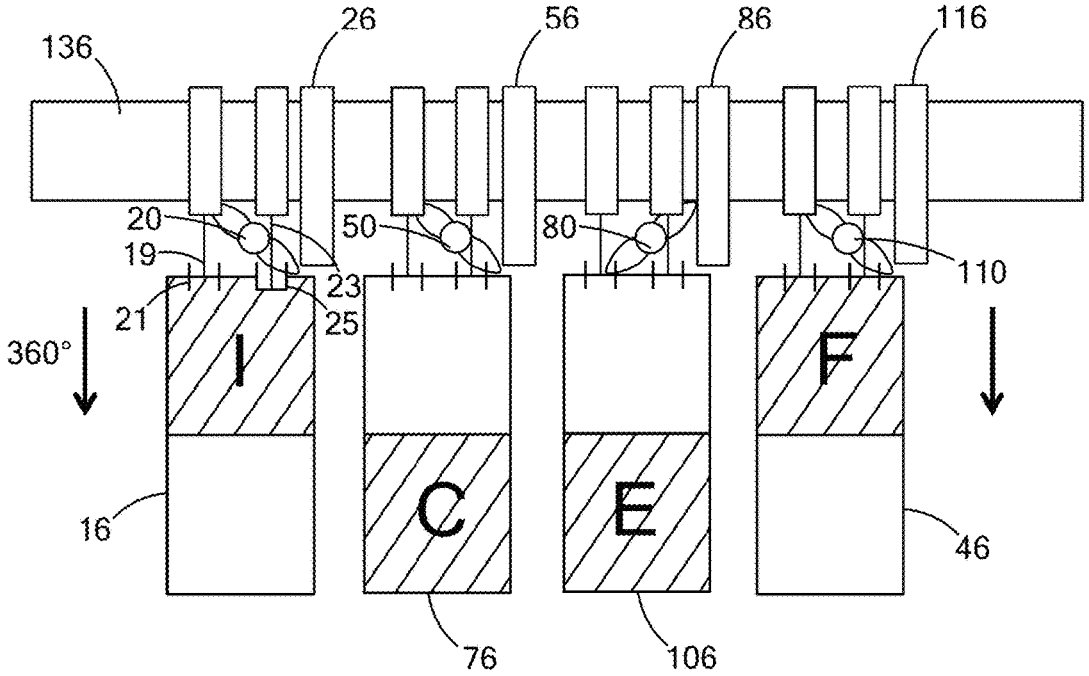
Figure 2F:
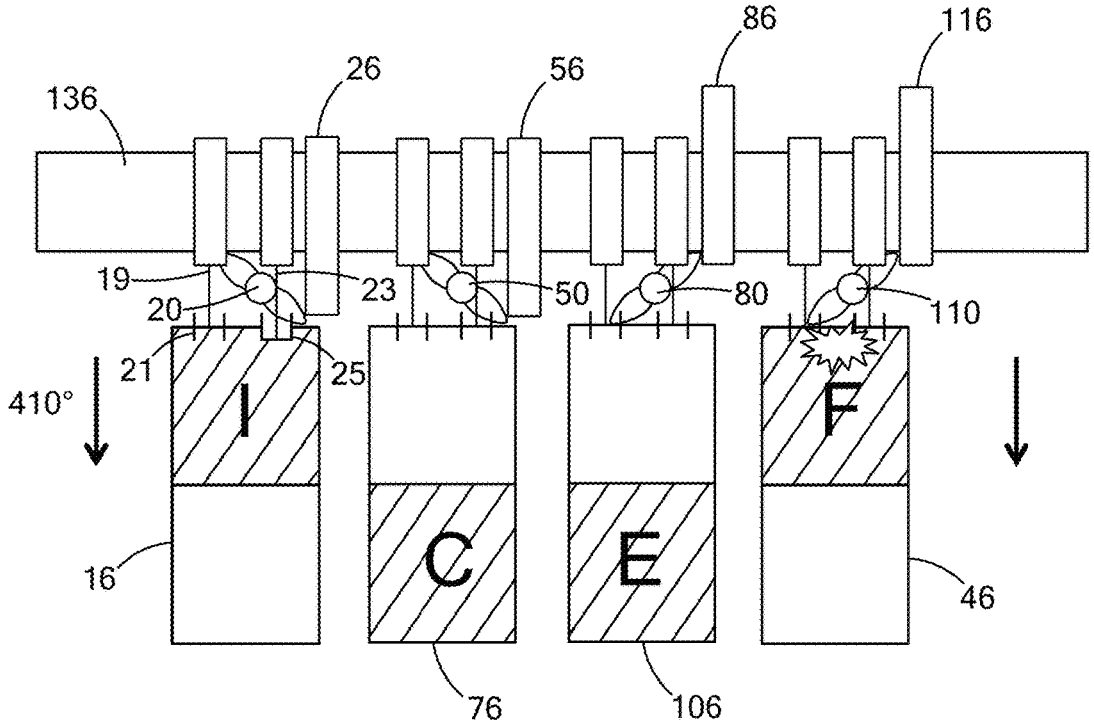

In FIG. 2E, the crank angle has rotated to 360°, and the second cylinder 46 is preparing for its firing stroke. In this position, the first cylinder 16 is intaking air via the first primary intake port 25. In FIG. 2F, the second cylinder 46 is in its firing stroke, generating a second exhaust gas. A portion of the second exhaust gas is exhausted through only the second auxiliary exhaust port. Subsequently, the portion of the second auxiliary exhaust gas is intaken from the second auxiliary exhaust port two only the first auxiliary intake port. After intaking, a remainder of the second exhaust gas is exhausted through the second primary exhaust port.

Figure 2G:
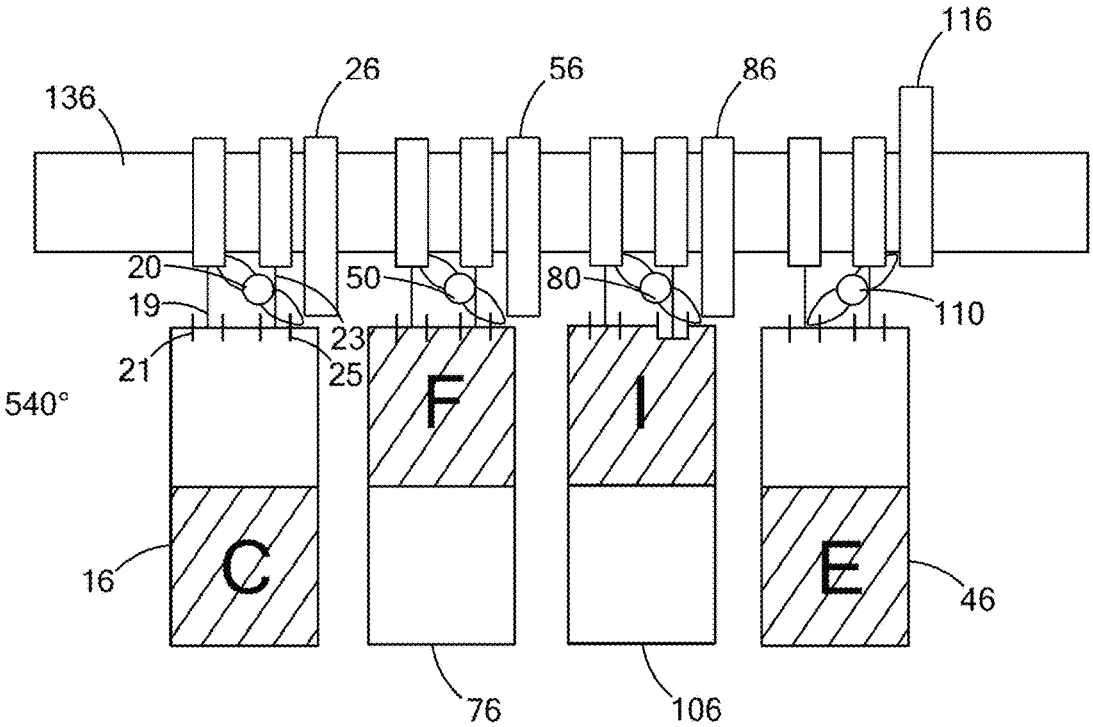

In FIG. 2G, the crank angle has rotated it to 540° about the valve actuator 136, and the fourth cylinder is intaking air via the fourth primary intake port. Subsequently, the third cylinder may fire, wherein firing the third cylinder generate a third exhaust gas. A portion of the third exhaust gas may exhaust through only the third auxiliary exhaust port. Then, the portion of the third exhaust gas may be intaken from the third auxiliary exhaust port into only the fourth auxiliary intake port. Subsequently, a remainder of the third exhaust gas may be exhausted through the third primary exhaust port.

As shown in FIGS. 2A-G, the overall firing sequence and blowdown sequence may be: cylinder 16, cylinder 106, cylinder 46, cylinder 76. The overall intaking sequence may be: cylinder 46, cylinder 76, cylinder 16, cylinder 106.

Figure 3A:
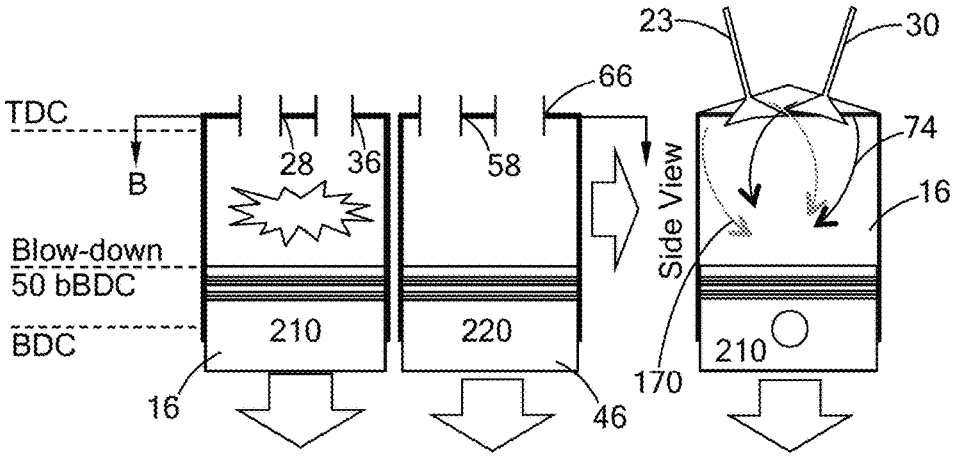
FIGS. 3A-C depict cylinder firing sequences of the engine of FIG. 1.
Figure 3B:
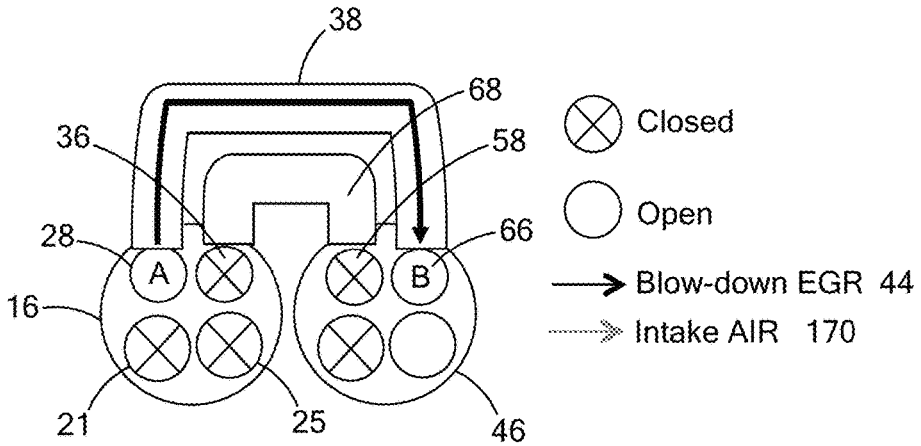
Figure 3C:
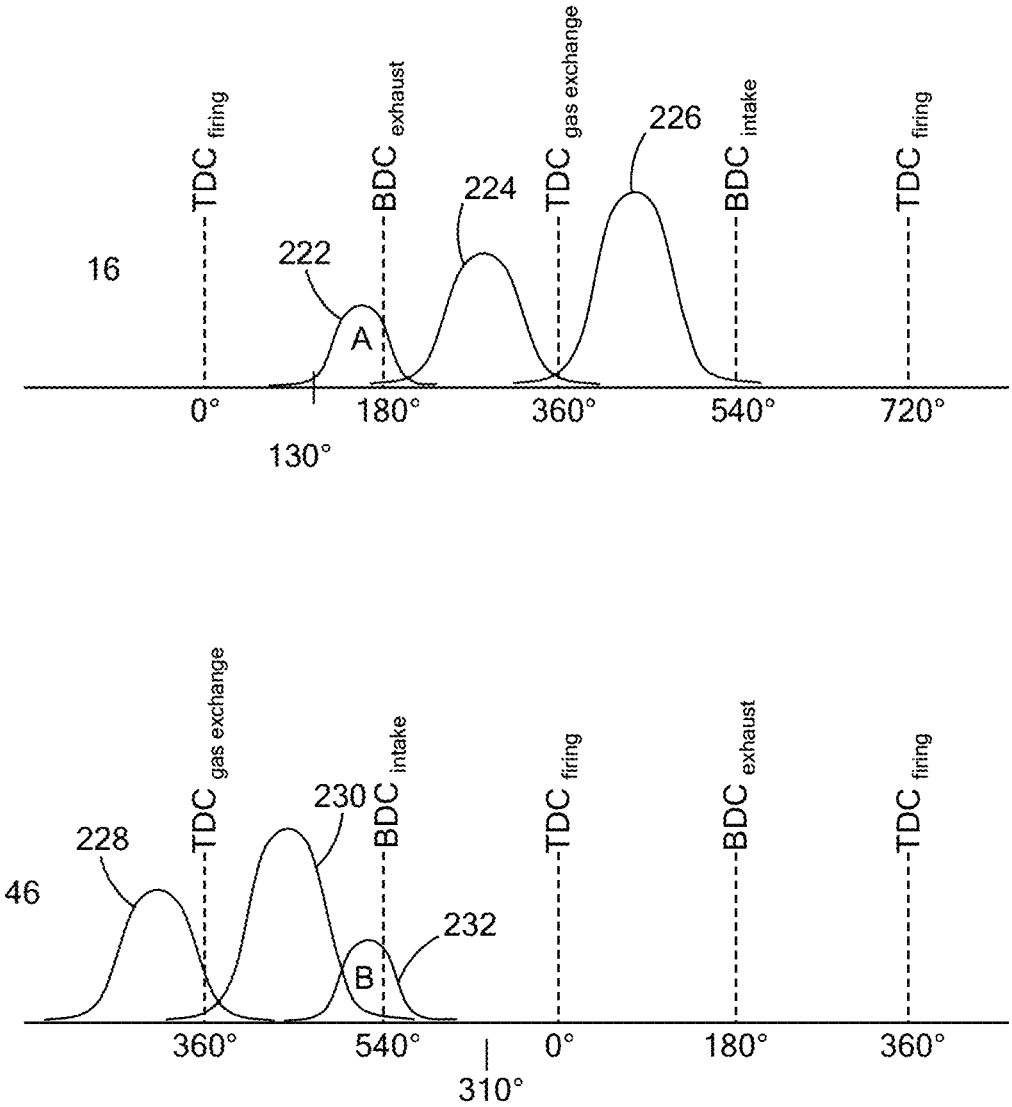

FIGS. 3A-C show further details of firing and intaking for two paired cylinders. For example, the first cylinder 16 with piston 210 is in its firing stroke. In this firing stroke, at 50° crank angle, the intake port 36 would be closed and the exhaust port 28 would be exhausting from the first cylinder 16 into the second cylinder 46. The second cylinder 46 with piston 220 may be in its intaking stroke. In this position, the second cylinder 46 would be intaking EG directly from the first auxiliary exhaust port 28 into the second auxiliary intake for 66. The second auxiliary exhaust port 58 would be closed.

When cylinder 16 is intaking, first primary intake valve 23 will be open for air 170 and the first auxiliary intake valve 30 will be open to intake second exhaust gas 74. Line B-B depicts a top view, shown further in FIG. 3B. FIG. 3B shows the top of the first and second cylinders (16, 46) when the first cylinder 16 is in its firing stroke and the second cylinder 46 is in it intaking stroke. First auxiliary exhaust port 28 is open to allow first flow path 38 to connect from only the first auxiliary exhaust port 28 directly into the second auxiliary intake port 66, which is also open.

Simultaneously, the second primary intake port of the second cylinder 46 is also open. At this time, the second primary exhaust port of the second cylinder 46 is closed, the second auxiliary exhaust port 58 is closed, and the second flow path 68 contains no EG. The first auxiliary intake port 36 is closed, and the first primary exhaust and intake ports (21, 25) are also closed.

FIG. 3C shows graphs of the paired first and second cylinders (16, 46). For example, the first cylinder 16 begins exhausting a first exhaust gas at approximately 50° crank angle, showing in peak 222. After a portion of the first exhaust gas is exhausted, the remainder of the first exhaust gas exhausts through the first primary exhaust port, in peak 224. Around 360° crank angle, the first cylinder 16 began intaking air, shown in peak 226.

Correspondingly, the second cylinder 46 is finishing exhausting a second exhaust gas through the second primary exhaust port, in peak 228. Subsequently in peak 230, the second cylinder 46 begins it intaking stroke. This intaking stroke begins slightly before the first cylinder 16 starts to exhaust the first exhaust gas (peak 222). Next in peak 232, the second cylinder 46 begins intaking the first exhaust gas through the second auxiliary intake port.

Figure 4A:
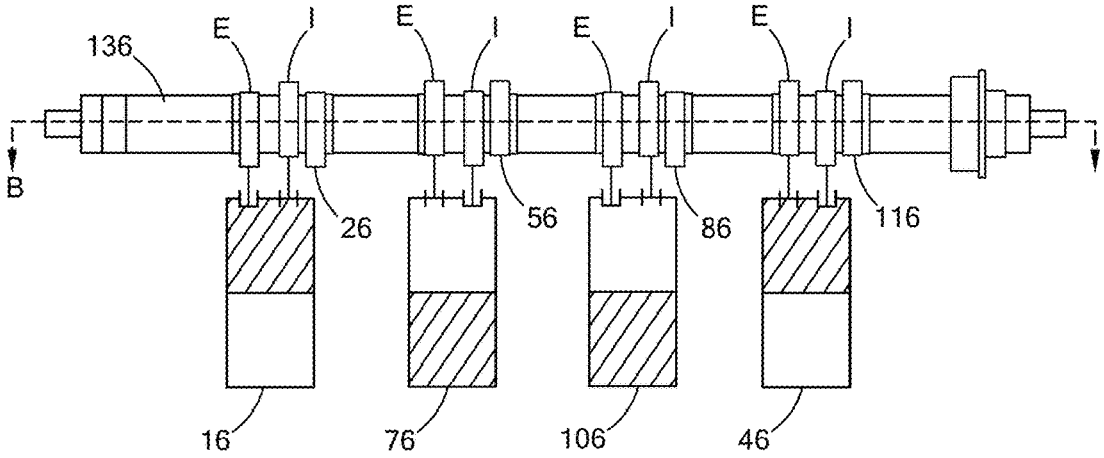
FIGS. 4A-C depict a valve actuation system of the engine of FIG. 1.
Figure 4B:
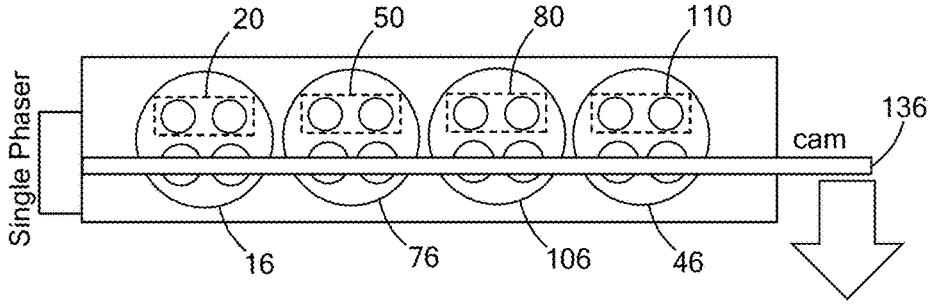
Figure 4C:
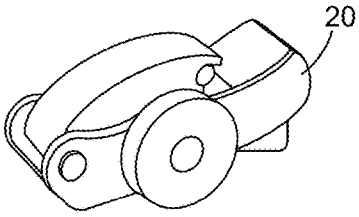

FIGS. 4A-C show further details of the valve actuator and rocker arms for controlling the cylinders. The valve actuator 136 may be a SOHO. More preferably, the valve actuator 136 has a cam-in-cam arrangement to accommodate operation of the primary and auxiliary valves. FIG. 4A depicts each cylinder having three operably connected lobes around the cam 136. Lobe E may control the primary exhaust valve. Lobe I may control the primary intake valve. The third lobe positioned with each cylinder may control the rocker arm associated with each cylinder (i.e. a rocker arm lobes 26, 56, 86, 116).

Line B-B depicts a top view shown in FIG. 4B. FIG. 4B depicts a top view. The cam 136 is positioned above the primary exhaust and intake valves of each cylinder. In addition, the auxiliary exhaust and intake valves are shown next to the primary exhaust and intake valves. Each auxiliary exhaust and intake valve has a corresponding rocker arm positioned above. FIG. 4C depicts one exemplary rocker arm (e.g. first rocker arm 20).

The first rocker arm 20 will be used as an example to demonstrate the details of any rocker arm (50, 80, 110). The first rocker arm 20 may be operably connected to the first auxiliary intake valve, in a first intake position. The first intake position allows the first cylinder to intake directly from the second cylinder. The first rocker arm 20 may be operably connected to the first auxiliary exhaust valve, in a first exhaust position. The first exhaust position allows the first cylinder to exhaust directly into the second cylinder.

Likewise, the second rocker arm 50 may be operably connected to the second auxiliary intake valve, and a second intake position. The second rocker arm 50 may also be operably connected to the second auxiliary exhaust valve, and a second exhaust position. The first rocker arm 20 may be movable between the first exhaust and intake position by the valve actuator 136 because the valve actuator may have a first rocker arm lobe 26. The first rocker arm lobe 26 may have 360° rotation about the valve actuator 136.

It may be apparent to one skilled in the art that the first rocker arm 20 may be in the first exhaust position when the second rocker arm 50 may be in the second intake position. Correspondingly, the first rocker arm 20 may be in the first intake position when the second rocker arm 50 is in the second exhaust position. This arrangement may provide for exchange of EG between the first and second cylinders.

As stated above, a third rocker arm 80 may be operably connected to the third auxiliary intake valve, in a third intake position. The third rocker arm 80 may also be operably connected to the third auxiliary exhaust valve, and a third exhaust position. The fourth rocker arm 110 may be operably connected to the fourth auxiliary intake valve, and a fourth intake position. The fourth rocker arm 110 may also be connected operably to the fourth auxiliary exhaust valve, in a fourth exhaust position.

It will be understood that the rocker arms could be operated in the opposite manner, such that contacting one rocker arm with an intake valve closes the intake valve and operates the corresponding exhaust position, and contacting the one rocker arm with the exhaust valve closes the exhaust valve and operates the corresponding intake position. Likewise, electronically controlled valves may also be used in place of the camshaft and/or rocker arms.

Figure 5A:
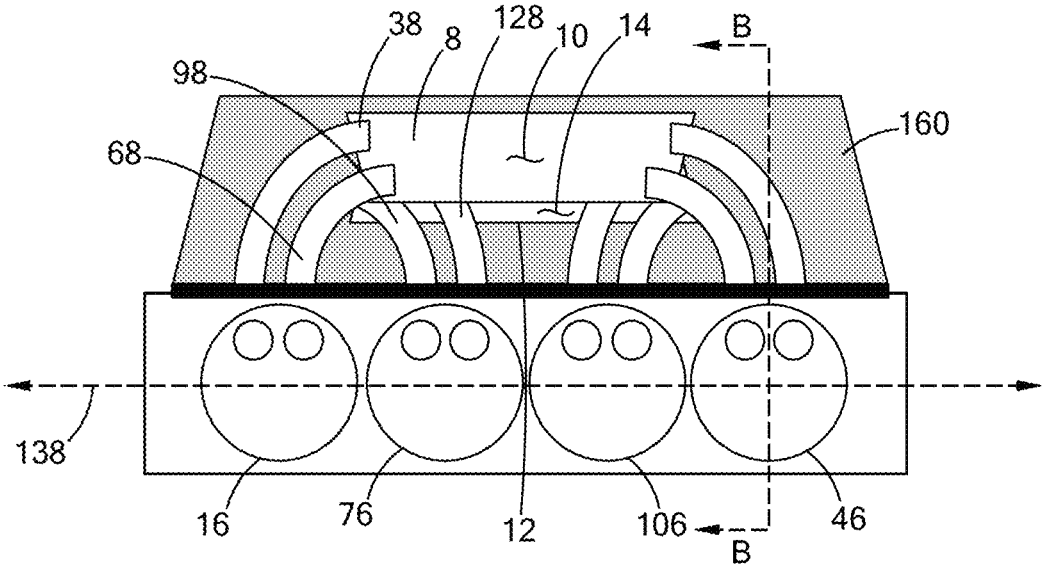
FIGS. 5A-B depict chambers of the engine of FIG. 1.

FIG. 5 depicts another view of the chambers (8, 12). In FIG. 5A, one skilled in the art will understand that second chamber 12 may be obscured by first chamber 8. The first chamber 8 may have a first volume 10 being equal to the second volume 14 of the second chamber 12. Additionally, cooling element 160 may be disposed about both chambers. The first flow path 38 may flow from the first cylinder 16 through first chamber 8 into the second cylinder 46, without flowing into the second chamber at all. Likewise, the second flow path 68 may flow from the second cylinder 46 through the first chamber 8 into the first cylinder 16.

Figure 5B:
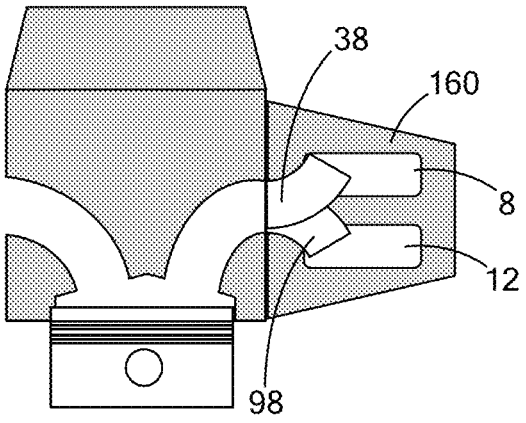

In a similar manner, the third flow path 98 may flow from the third cylinder 76 through the second chamber 12 into the fourth cylinder 106, without flowing into the first chamber at all. The fourth flow path 128 may flow from the fourth cylinder 106 through the second chamber 12 to the third cylinder 76. Line B-B depicts an end view of the chambers. In FIG. 5B, the first chamber 8 is not fluidly connected to the second chamber 12.

It should be understood that the foregoing relates to exemplary embodiments of the disclosure and that modifications may be made without departing from the spirit and scope of the disclosure as set forth in the following claims. While the disclosure has been described with respect to certain embodiments it will be appreciated that modifications and changes may be made by those skilled in the art without departing from the spirit of the disclosure.

The invention claimed is:

1. An internal combustion engine having a first and a second cylinder, the engine comprising:

the first cylinder having a first exhaust port operably connected to a first exhaust valve, and a first intake port operably connected to a first intake valve;

the second cylinder having a second exhaust port operably connected to a second exhaust valve, and a second intake port operably connected to a second intake valve, a flow path directly connecting the first and second cylinders; and a valve actuator operably connected to the first exhaust and intake valves and the second exhaust and intake valves to open and close the first exhaust and intake ports and the second exhaust and intake ports, respectively, the valve actuator operating the valves to directly connect the first exhaust port to only the second intake port, and directly connect the second exhaust port to only the first intake port, to provide direct exchange of exhaust gases between the first and second cylinders.

2. The engine of claim 1 further comprising a third cylinder and a fourth cylinder, the third cylinder having a third exhaust port operably connected to a third exhaust valve, and a third intake port operably connected to a third intake valve, the fourth cylinder having a fourth exhaust port operably connected to a fourth exhaust valve, and a fourth intake port operably connected to a fourth intake valve, the valve actuator operably connected to the third exhaust and intake valves and the fourth exhaust and intake valves to open and close the third exhaust and intake ports and the fourth exhaust and intake ports, respectively, the valve actuator operating the valves to directly connect the third exhaust port to only the fourth intake port, and directly connect the fourth exhaust port to only the third intake port, to provide direct exchange of exhaust gases between the third and fourth cylinders.

3. The engine of claim 2 wherein neither the first cylinder nor the second cylinder is fluidically connected to either of the third cylinder or the fourth cylinder via their respective exhaust and intake ports.

4. The engine of claim 2 further comprising an exhaust gas exchange manifold having a first chamber and a second chamber, the first chamber directly connecting the first cylinder to only the second cylinder, the second chamber directly connecting the third cylinder to only the fourth cylinder.

5. The engine of claim 4 wherein the first chamber has a first length and a first volume and the second chamber has a second length and a second volume, the first length being about the same as the second length, the first volume being about the same as the second volume.

6. The engine of claim 4 wherein the first chamber is not in fluid communication with the second chamber.

7. The engine of claim 1 further comprising a first rocker arm being operably connected to the first intake valve, in a first intake position, the first rocker arm being operably connected to the first exhaust valve, in a first exhaust position, and further comprising a second rocker arm being operably connected to the second intake valve, in a second intake position, the second rocker arm being operably connected to the second exhaust valve, in a second exhaust position.

8. The engine of claim 7 wherein the first rocker arm is movable between the first exhaust and intake positions by the valve actuator having a first rocker arm lobe, the first rocker arm lobe having 360° rotation about the valve actuator, wherein the first rocker arm is in the first exhaust position when the first rocker arm lobe is positioned at about 50° rotation about the valve actuator.

9. The engine of claim 7 wherein the first rocker arm is in the first exhaust position when the second rocker arm is in the second intake position, and the first rocker arm is in the first intake position when the second rocker arm is in the second exhaust position to provide exchange of exhaust gases between the first and second cylinders.

10. The engine of claim 2 further comprising a third rocker arm being operably connected to the third intake valve, in a third intake position, the third rocker arm being operably connected to the third exhaust valve, in a third exhaust position, and further comprising a fourth rocker arm being operably connected to the fourth intake valve, in a fourth intake position, the fourth rocker arm being operably connected to the fourth exhaust valve, in a fourth exhaust position.

11. The engine of claim 4 wherein the exhaust gas exchange manifold includes a cooling element, the cooling element disposed about the first and second chambers to cool the exhaust gases.

12. The engine of claim 1 wherein a first exhaust gas flows from the first exhaust port only to the second intake port, and a second exhaust gas flows from the second exhaust port only to the first intake port.

13. An internal combustion engine defining a longitudinal axis and having a primary exhaust manifold and an exhaust gas recirculation manifold, the engine comprising:

a first cylinder positioned between a first side and a second side of the engine, the first side being opposite the second side about the longitudinal axis, the first cylinder having a first primary exhaust port operably connected to a first primary exhaust valve, a first primary intake port operably connected to a first primary intake valve, a first auxiliary exhaust port operably connected to a first auxiliary exhaust valve, and a first auxiliary intake port operably connected to a first auxiliary intake valve;

a second cylinder positioned in-line with the first cylinder and between the first side and the second side of the engine, the second cylinder having a second primary exhaust port operably connected to a second primary exhaust valve, a second primary intake port operably connected to a second primary intake valve, a second auxiliary exhaust port operably connected to a second auxiliary exhaust valve, and a second auxiliary intake port operably connected to a second auxiliary intake valve;

the primary exhaust manifold positioned on the first side of the engine, the exhaust recirculation manifold positioned on the second side of the engine; and the first primary exhaust and intake ports and the second primary exhaust and intake ports being positioned on the first side, and the first auxiliary exhaust and intake ports and the second auxiliary exhaust and intake ports being positioned on the second side, wherein the first and second primary exhaust ports are in selective fluid communication with the primary exhaust manifold, and the first and second auxiliary exhaust and intake ports are in selective fluid communication with the exhaust gas recirculation manifold.

14. The engine of claim 13 wherein the exhaust gas recirculation manifold comprises a first flow path connected to the first auxiliary exhaust port and extending only from the first auxiliary exhaust port to the second auxiliary intake port, the first flow path being in selective fluid communication with the first cylinder and the second cylinder by way of the first auxiliary exhaust port and the second auxiliary intake port.

15. The engine of claim 14 wherein the exhaust gas recirculation manifold comprises a second flow path connected to the second auxiliary exhaust port and extending only from the second auxiliary exhaust port to the first auxiliary intake port, the second flow path being in selective fluid communication with the first cylinder and the second cylinder by way of the second auxiliary exhaust port and the first auxiliary intake port.

16. A method of operating exhaust gas recirculation in an internal combustion engine, the method comprising:

providing the engine having, a first cylinder having a first primary exhaust port, a first primary intake port, a first auxiliary exhaust port, and a first auxiliary intake port; and a second cylinder having a second primary exhaust port, a second primary intake port, a second auxiliary exhaust port, and a second auxiliary intake port;

intaking air into the second cylinder via the second primary intake port;

firing the first cylinder, wherein firing the first cylinder generates a first exhaust gas;

exhausting a portion of the first exhaust gas through only the first auxiliary exhaust port;

intaking the portion of the first exhaust gas from the first auxiliary exhaust port into only the second auxiliary intake port; and exhausting a remainder of the first exhaust gas through the first primary exhaust port.

17. The method of claim 16 further comprising:

intaking air into the first cylinder via the first primary intake port;

firing the second cylinder, wherein firing the second cylinder generates a second exhaust gas;

exhausting a portion of the second exhaust gas through only the second auxiliary exhaust port;

intaking the portion of the second exhaust gas from the second auxiliary exhaust port into only the first auxiliary intake port; and exhausting a remainder of the second exhaust gas through the second primary exhaust port.

18. The method of claim 16 wherein the step of providing the engine comprises the engine having a third cylinder having a third primary exhaust port, a third primary intake port, a third auxiliary exhaust port, and a third auxiliary intake port, and the engine having a fourth cylinder having a fourth primary exhaust port, a fourth primary intake port, a fourth auxiliary exhaust port, and a fourth auxiliary intake port.

19. The method of claim 18 further comprising:

intaking air into the fourth cylinder via the fourth primary intake port;

firing the third cylinder, wherein firing the third cylinder generates a third exhaust gas;

exhausting a portion of the third exhaust gas through only the third auxiliary exhaust port;

intaking the portion of the third exhaust gas from the third auxiliary exhaust port into only the fourth auxiliary intake port; and exhausting a remainder of the third exhaust gas through the third primary exhaust port.

20. The method of claim 18 further comprising:

intaking air into the third cylinder via the third primary intake port;

firing the fourth cylinder, wherein firing the fourth cylinder generates a fourth exhaust gas;

exhausting a portion of the fourth exhaust gas through only the fourth auxiliary exhaust port;

intaking the portion of the fourth exhaust gas from the fourth auxiliary exhaust port into only the third auxiliary intake port; and exhausting a remainder of the fourth exhaust gas through the fourth primary exhaust port.

* * * * *